US010047973B2

(12) United States Patent
Gao

(10) Patent No.: US 10,047,973 B2
(45) Date of Patent: Aug. 14, 2018

(54) INTEGRATED HEATING AND BLOWING ARRANGEMENT FOR HEATER MACHINE

(71) Applicant: Shenzhen Sunzone Electrical Appliances Ltd., Shenzhen (CN)

(72) Inventor: Tianyu Gao, Shenzhen (CN)

( * ) Notice: Subject to any disclaimer, the term of this patent is extended or adjusted under 35 U.S.C. 154(b) by 345 days.

(21) Appl. No.: 14/617,959

(22) Filed: Feb. 10, 2015

(65) Prior Publication Data

US 2016/0231020 A1 Aug. 11, 2016

(51) Int. Cl.

| | |
|---|---|
| ***F24H 3/04*** | (2006.01) |
| ***H05B 3/06*** | (2006.01) |
| ***H05B 3/00*** | (2006.01) |
| ***H05B 3/24*** | (2006.01) |
| ***H05B 3/42*** | (2006.01) |

(52) U.S. Cl.

CPC ..... *F24H 3/0411* (2013.01); *H05B 3/06* (2013.01); *H05B 3/24* (2013.01); *H05B 3/42* (2013.01); *H05B 2203/016* (2013.01); *H05B 2203/02* (2013.01); *H05B 2203/023* (2013.01)

(58) Field of Classification Search

CPC ..... F24H 3/0411; H05B 3/06; H05B 3/24; H05B 2203/023; H05B 2203/016; H05B 2203/02; H05B 3/42

USPC ..... 219/520

See application file for complete search history.

(56) References Cited

U.S. PATENT DOCUMENTS

| | | | | |
|---|---|---|---|---|
| 5,192,853 | A * | 3/1993 | Yeh | H05B 3/06 219/505 |
| 5,513,296 | A * | 4/1996 | Goldstein | F24H 3/0417 392/365 |
| 2007/0297773 | A1* | 12/2007 | Gao | F04D 17/04 392/360 |
| 2008/0083718 | A1* | 4/2008 | Gao | F24H 3/0405 219/202 |
| 2008/0124060 | A1* | 5/2008 | Gao | F24H 3/0417 392/365 |

* cited by examiner

*Primary Examiner* — Dana Ross
*Assistant Examiner* — Kuangyue Chen
(74) *Attorney, Agent, or Firm* — Novoclaims Patent Services LLC; Mei Lin Wong

(57) ABSTRACT

A heater includes an outer casing having an air inlet, an air outlet, and a receiving cavity defined between the air inlet and the air outlet, and an integrated air heating and blowing arrangement. The integrated air heating and blowing arrangement includes a fan assembly mounted in the receiving cavity for drawing air from ambient environment to pass through the air inlet and the air outlet, and a heating apparatus arranged to heat up the air drawn by the fan assembly. The heating apparatus is coupled with the fan assembly to form an integrated structure for being detachably mounted in the receiving cavity of the outer casing.

5 Claims, 12 Drawing Sheets

INTEGRATED HEATING AND BLOWING ARRANGEMENT FOR HEATER MACHINE

BACKGROUND OF THE PRESENT INVENTION

Field of Invention

The present invention relates to a heater, and more particularly to a heater with an integrated air heating and blowing arrangement which may be conveniently attached to an outer casing.

Description of Related Arts

Devices which aim to control the temperature in a predetermined area have widely been used throughout the world. These devices include air conditioners, electric fans, heaters, or the likes. Air conditioners utilize refrigerant to absorb heat from air for reducing the temperature within a confined space. Heaters increases the temperature of air blowing therethrough. Conventional heaters are more popular than air conditioners because they are less expensive, much smaller in size, and generally effective in increasing the temperature of air in a confined space.

A conventional heater usually comprises an outer casing, a Positive Temperature Coefficient (PTC) heating module, a fan assembly and a temperature control device. The fan assembly draws air from ambient environment which is then heated up by the PTC heating module. The heated air is then blown out of the outer casing by the fan assembly. A major disadvantage of the above-mentioned conventional heater is that all the components of the heater are individually manufactured (usually by different manufacturers) and individually mounted or assembled in the outer casing. As a result, this involves complicated and inefficient manufacturing process which in turns easily cause problems involving product quality and stability.

Thus, there is a need to tackle the above-mentioned problem and develop a heater which has simple manufacturing procedures which enhance the general quality and stability of the resulting heater.

SUMMARY OF THE PRESENT INVENTION

An objective of the present invention is to provide an integrated air heating and blowing arrangement for a heater which may be conveniently attached to an outer casing of the heater.

Another objective of the present invention is to provide a heater which comprises an integrated air heating and blowing arrangement, wherein PTC heating assemblies may be conveniently and securely mounted in the outer casing so as to facilitate easy, low-cost and convenient manufacturing procedure of the present invention.

In one aspect of the present invention, it provides a heater, comprising:

an outer casing having an air inlet, an air outlet, and a receiving cavity defined between the air inlet and the air outlet;

an integrated air heating and blowing arrangement, which comprises:

a fan assembly mounted in the receiving cavity for drawing air from ambient environment to pass through the air inlet and the air outlet; and a heating apparatus arranged to heat up the air drawn by the fan assembly, the heating apparatus being coupled with the fan assembly to form an integrated structure for being detachably mounted in the receiving cavity of the outer casing.

In another aspect of the present invention, it provides an integrated air heating and blowing arrangement for a heater having an outer casing having an air inlet, an air outlet, and a receiving cavity defined between the air inlet and the air outlet, the integrated air heating and blowing arrangement comprising:

a fan assembly mounted in the receiving cavity for drawing air from ambient environment to pass through the air inlet and the air outlet; and a heating apparatus arranged to heat up the air drawn by the fan assembly, the heating apparatus being coupled with the fan assembly to form an integrated structure for being detachably mounted in the receiving cavity of the outer casing.

DETAILED DESCRIPTION OF THE PREFERRED EMBODIMENT

Figure 1:
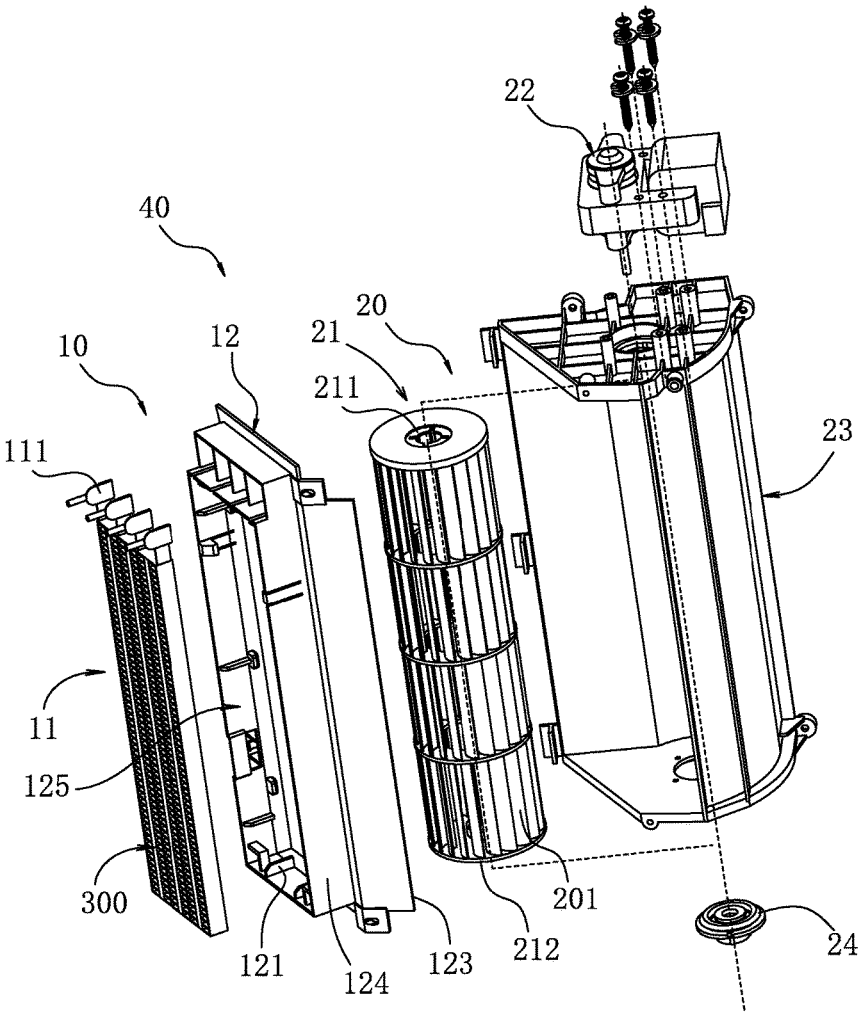
FIG. 1 is an exploded perspective view of an integrated air heating and blowing arrangement for a heater according to a first preferred embodiment of the present invention.

Referring to FIG. 1 to FIG. 7 of the drawings, a heater 100 according to a preferred embodiment of the present invention is illustrated. Broadly, the heater 100 comprises an outer casing 30, and an integrated air heating and blowing arrangement 40. The integrated air heating and blowing arrangement 40 comprises a fan assembly 20 and a heating apparatus 10.

The outer casing 30 has at least one air inlet 31, an air outlet 32, and a receiving cavity 33 defined between the air inlet 31 and the air outlet 32. The integrated air heating and blowing arrangement 40 comprises the fan assembly 20 and the heating apparatus 10. Both are received in the receiving cavity 33 of the outer casing 30.

The fan assembly 20 is mounted in the receiving cavity 33 for drawing air from ambient environment to pass through the air inlet 31 and the air outlet 32.

The heating apparatus 10 is arranged to heat up the air drawn by the fan assembly 20, and is coupled with the fan assembly 20 to form an integrated structure for being detachably mounted in the receiving cavity 33 of the outer casing 30.

According to the preferred embodiment of the present invention, the outer casing 30 is elongated in structure in which the air inlet 31 is formed on one side of the outer casing 30, while the air outlet 32 is formed in an opposed side of the outer casing 30, so that ambient air drawn by the fan assembly 20 is forced to pass through the receiving cavity 33 along a transverse direction of the outer casing 30. In normal operation, the outer casing 30 is adapted to stand on a flat surface.

The fan assembly 20 comprises a tubular fan rotor 21, a plurality of fan blades 201 provided on the tubular fan rotor 21, a fan motor 22 coupled with the tubular fan rotor 21 for driving the fan rotor 21 to rotate in a predetermined speed, and a fan housing 23 supported in the outer casing 30, wherein the tubular fan rotor 21 and the fan motor 22 are mounted and received in the fan housing 23. When the tubular fan rotor 21 is driven to rotate, the fan blades 201 are also driven to rotate in a corresponding direction.

Figure 2:
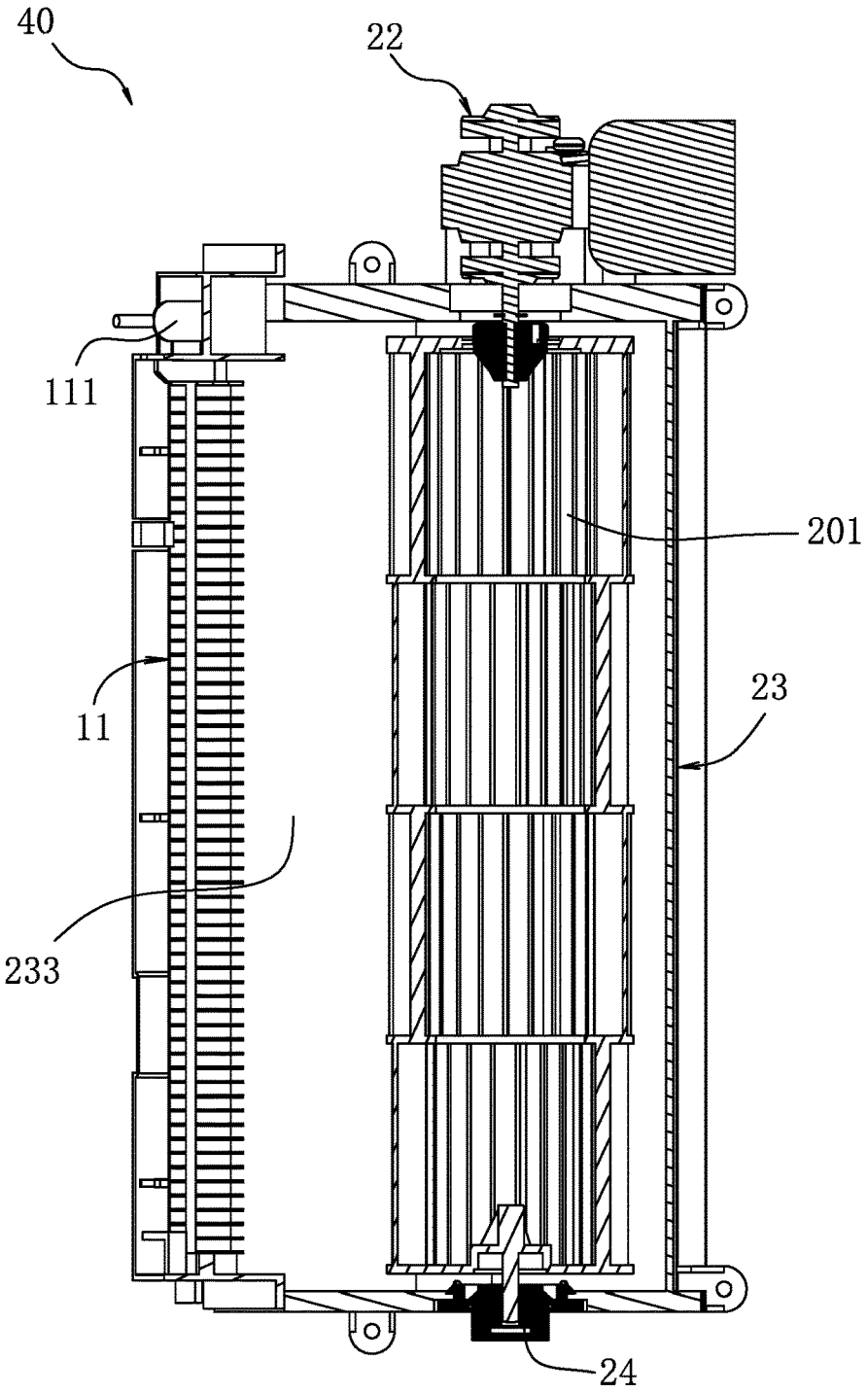
FIG. 2 is a sectional side view of the integrated air heating and blowing arrangement according to the first preferred embodiment of the present invention.
Figure 3:
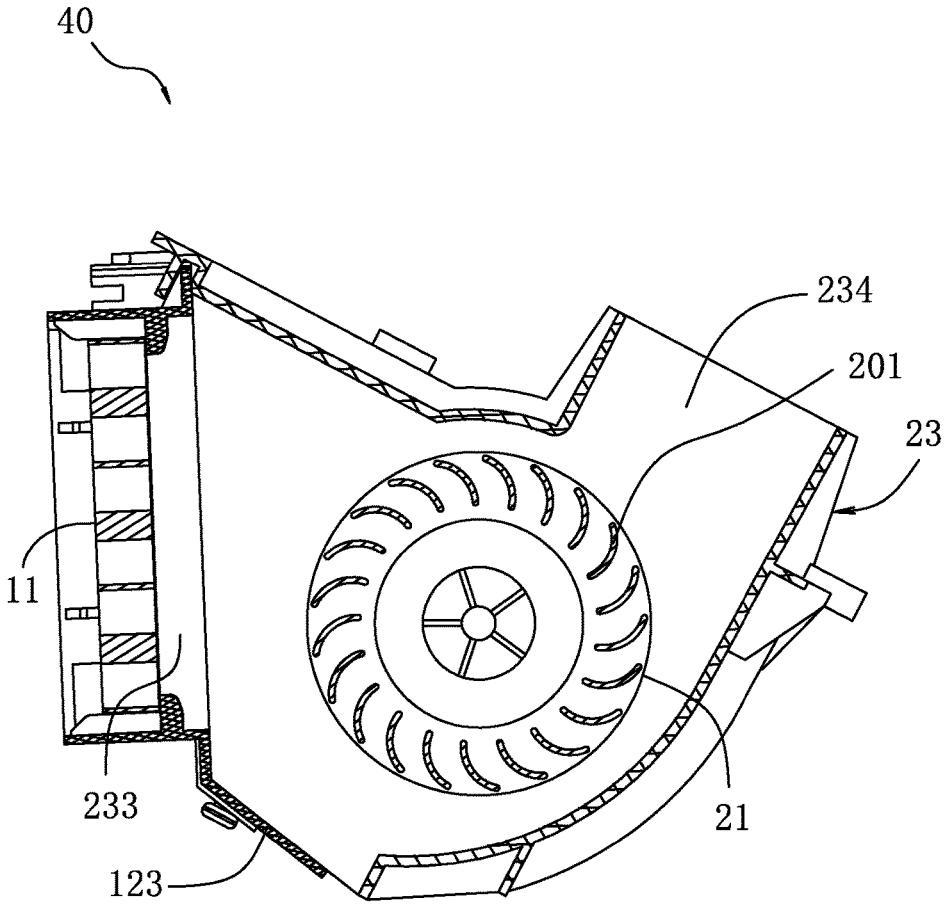
FIG. 3 is a sectional top view of the integrated air heating and blowing arrangement according to the first preferred embodiment of the present invention.
Figure 4:
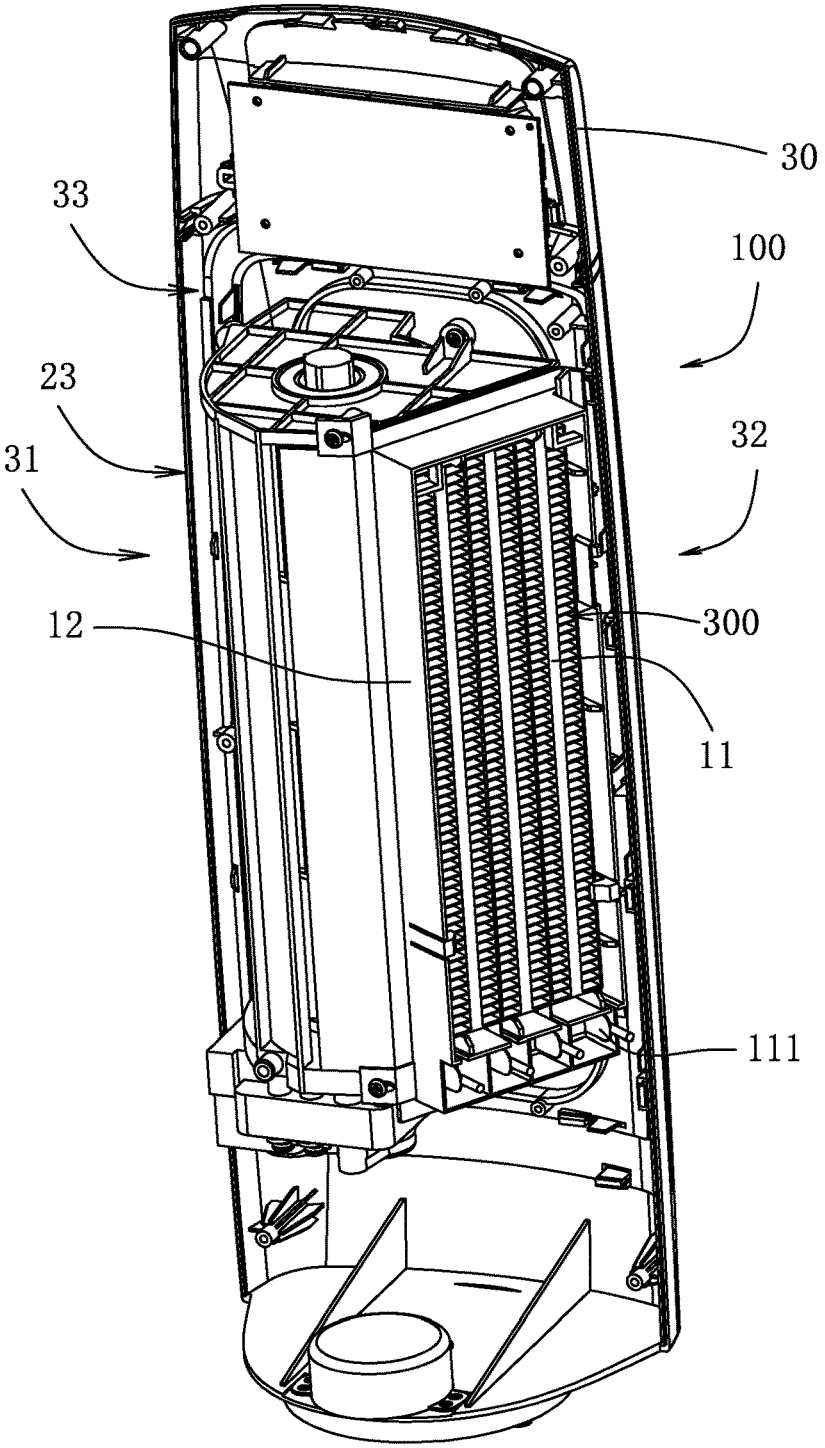
FIG. 4 is a perspective view of the heater according to the first preferred embodiment of the present invention.

As shown in FIG. 2 of the drawings, the tubular fan rotor 21 and the fan housing 23 are also elongated in structure and has a shape and size corresponding to the outer casing 30 so that the fan housing 23 is capable of being rotatably supported in the receiving cavity 33 of the outer casing 30 for drawing air to flow from the air inlet 31 to the air outlet 32. In other words, the tubular fan rotor 21 is supported in the fan housing 23 in such a manner that a longitudinal axis of the fan tubular fan rotor 21 extends along a longitudinal direction of the fan housing 23.

Thus, the fan rotor 21 comprise a rotor frame 211 having a plurality of supporting members 212, wherein a predetermined number of fan blades 201 is spacedly supported between each two supporting members 212.

The fan motor 22 is supported in a bottom portion of the fan housing 23, and has a connecting shaft 221 rotatably connected to the bottommost supporting member 212 of the rotor frame 211 through a connector 24 and a through hole formed on the fan housing 23. It is worth mentioning that the fan housing 23 has an incoming air opening 233 and an outgoing air opening 234 which are positioned corresponding to the air inlet 31 and the air outlet 32 of the outer casing 30.

The heating apparatus 10 comprises a Positive Temperature Coefficient (PTC) heating assembly 11 and a PTC supporting frame 12. The PTC heating assembly 11 comprises a plurality of PTC assembly members 300 wherein the PTC heating assembly 11 is accommodated in the PTC supporting frame 12. Each of the PTC assembly members 300 comprises a PTC heating elements 301 and at least one connecting terminal 111 electrically connecting between the PTC assembly member 300 and a power source. When the connecting terminals 111 are electrically connected to a power source, the PTC heating elements 301 are heated so as to increase the temperature of the air through the PTC heating elements 301. In the preferred embodiment, there are three PTC assembly members 300 which are arranged in a side-by-side manner to form an integral body of the PTC heating assembly 11 and are supported in the PTC supporting frame 12.

As shown in FIG. 1 and FIG. 2 of the drawings, the PTC heating assembly 11 is supported along a longitudinal direction of the fan housing 23 while each of the PTC heating elements 301 is supported along a transverse direction of the fan housing 23.

Figure 5:
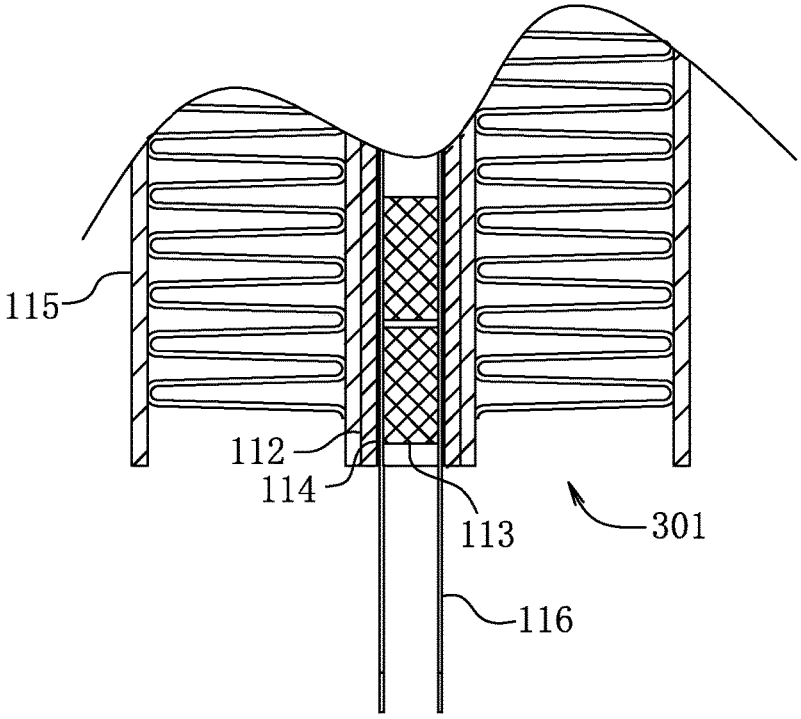
FIG. 5 is a schematic diagram of an integrated air heating and blowing arrangement of the heater according to the first preferred embodiment of the present invention, illustrated that PTC heating assembly is an uncharged PTC heating assembly.

It is important to mention that the PTC heating assembly 11 may be a charged PTC heating assembly 11 or an insulated PTC heating assembly 11. As shown in FIG. 5 of the drawings, it illustrates an insulated PTC heating assembly 11. Each of the PTC heating elements 301 comprises a thermal conductor 112, a heating member 113, an electrical insulating member 114, and a heat sink member 115. The thermal conductor 112 is preferably configured from metallic material and has a tubular structure for fittedly wrapping around the heating member 113. The conductor 112 is arranged to rapidly conduct heat from the heating member 113 to the heat sink member 115. The heating member 113 has a plurality of electrodes 116 extended to electrically connect to the corresponding connecting terminals 111 for acquiring electricity from the power source. The electrical insulating member 114 is provided between the thermal conductor 112 and the heating member 113 so that when the heating member 113 is connected to the power source, the thermal conductor 112 is insulated from electricity carried by the heating member 113. At the same time, however, heat may be rapidly transmitted from the heating member 113 to the thermal conductor 112 and then to the heat sink member 115. This particular configuration increases the safety feature of the present invention.

Figure 6:
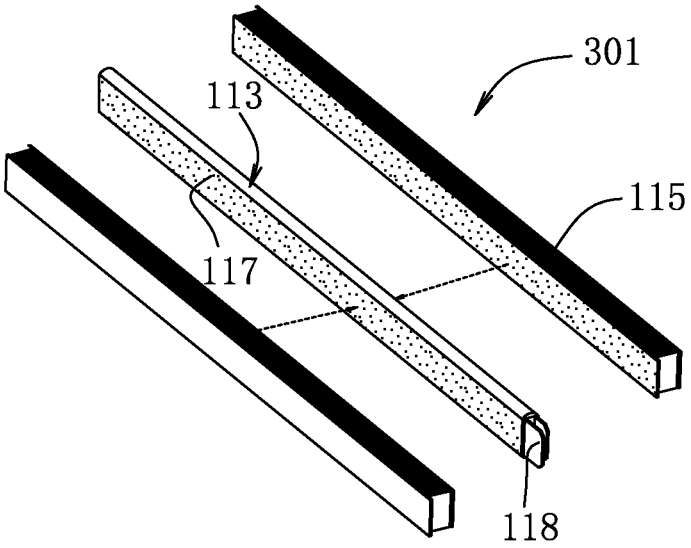
FIG. 6 is a schematic diagram of an integrated air heating and blowing arrangement of the heater according to the first preferred embodiment of the present invention, illustrated that PTC heating assembly is a charged PTC heating assembly.

As shown in FIG. 6 of the drawings, it illustrates a charged PTC heating assembly 11. The PTC heating assembly 11 comprises a heating member 113 and a heat sink element 115 connected to the heating member 113 in such a manner that the heat generated by the heating member 113 is arranged to be rapidly transmitted to the heat sink element 115. The heating member 113 has a plurality of conducting electrodes 117 provided on two sides of the heating member 113, and electrically connected to the heat sink element 115. The heating member 113 has a plurality of connecting electrodes 118 electrically connected to the connecting terminals 111. Therefore, when the heating member 113 is connected to the power source, the heating member 113 and the conducting electrodes 117 are all conducted with electricity.

Furthermore, the PTC supporting frame 12 comprises a frame body 124 having an accommodating cavity 125 sized and shaped to fittedly receive the PTC heating assemblies 11. The PTC supporting frame 12 further comprises a plurality of securing members 121 for securing the PTC heating assemblies 11 in the accommodating cavity 125. Specifically, the securing members 121 divide the accommodating cavity 125 into a corresponding number of compartments wherein each of the PTC heating assemblies 11 is fittedly supported and secured in the corresponding compartment.

The PTC supporting frame 12 further comprises a coupling member 123 formed at two sides thereof for connecting to the fan housing 23 at a position near the incoming air opening 233. This ensures that the fan assembly 20 can effectively draw air to pass through the heating apparatus.

Figure 7:
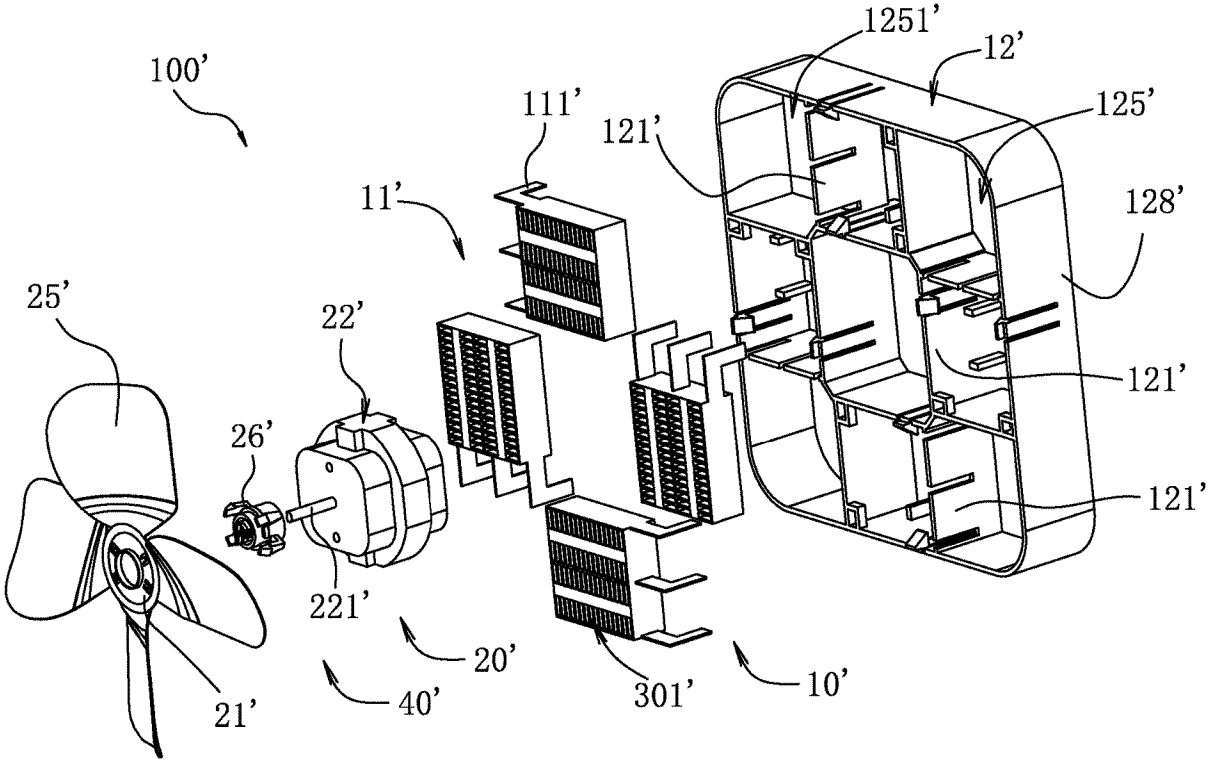
FIG. 7 is an exploded perspective view of an integrated air heating and blowing arrangement for a heater according to a second preferred embodiment of the present invention.
Figure 8:
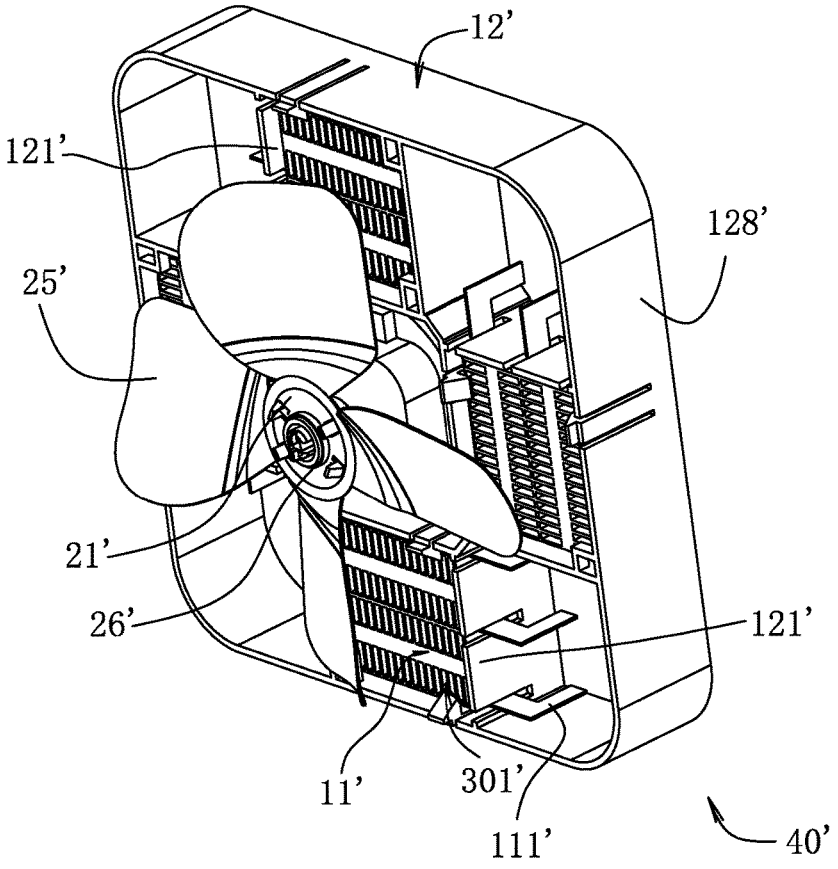
FIG. 8 is a perspective view of the integrated air heating and blowing arrangement according to the second preferred embodiment of the present invention.
Figure 9:
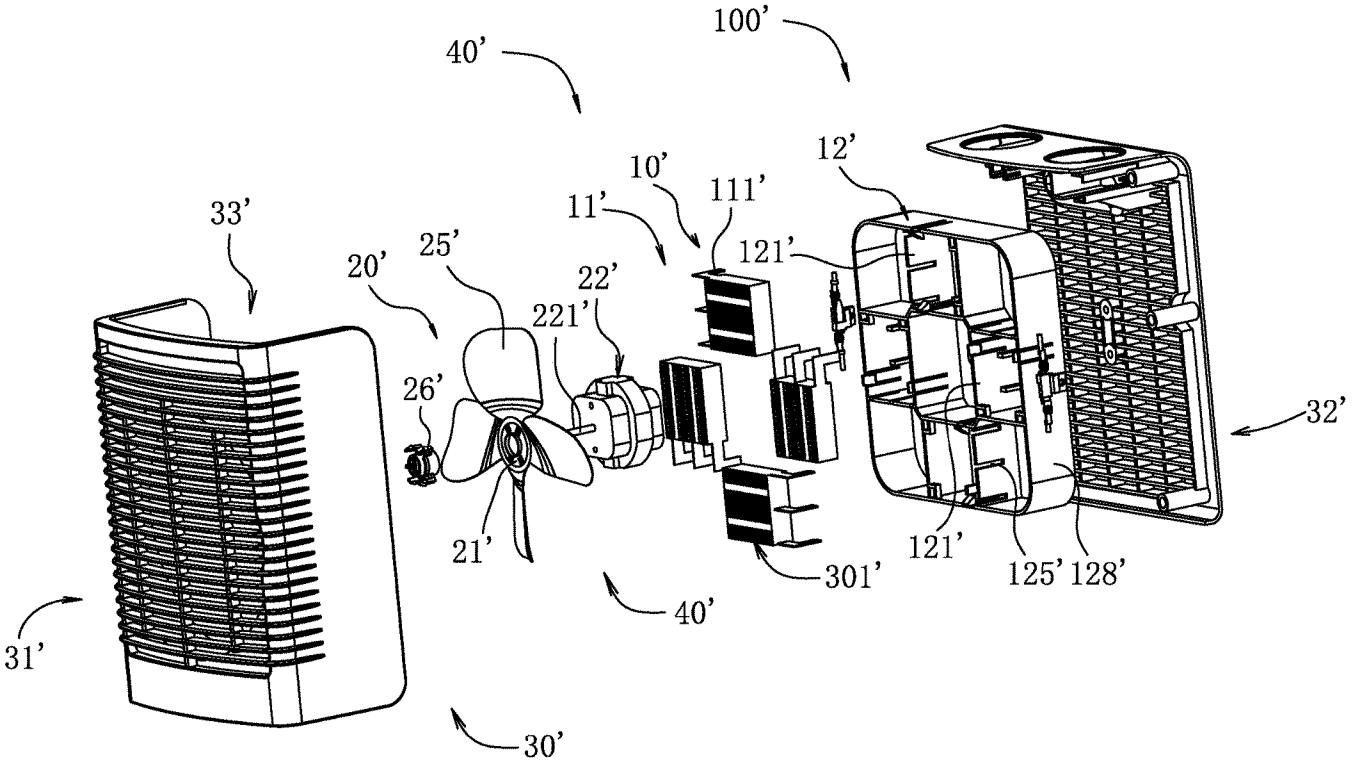
FIG. 9 is an exploded perspective view of a heater according to a second preferred embodiment of the present invention.
Figure 10:
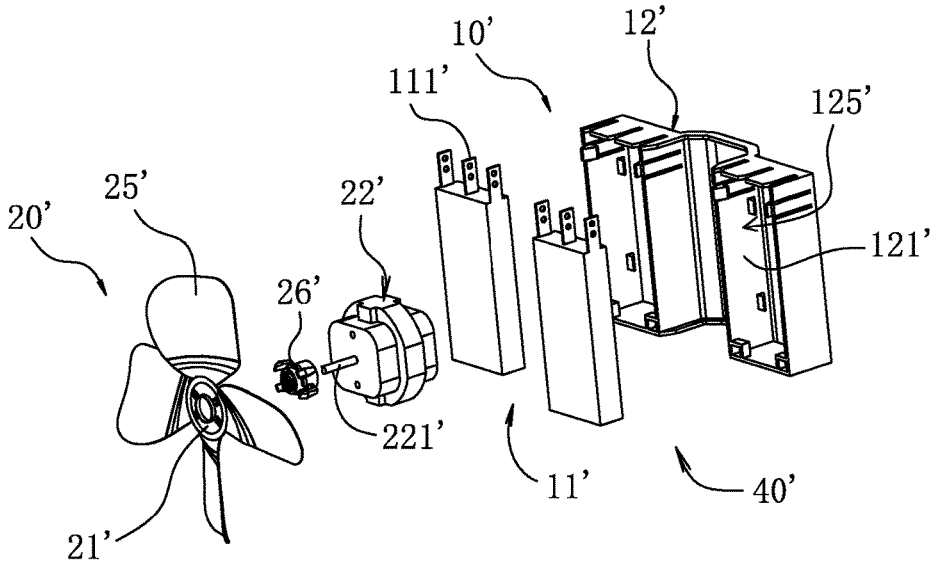
FIG. 10 is a schematic diagram of an integrated air heating and blowing arrangement of the heater according to the second preferred embodiment of the present invention, illustrating that a relative position of two PTC heating assemblies and a fan assembly.
Figure 11:
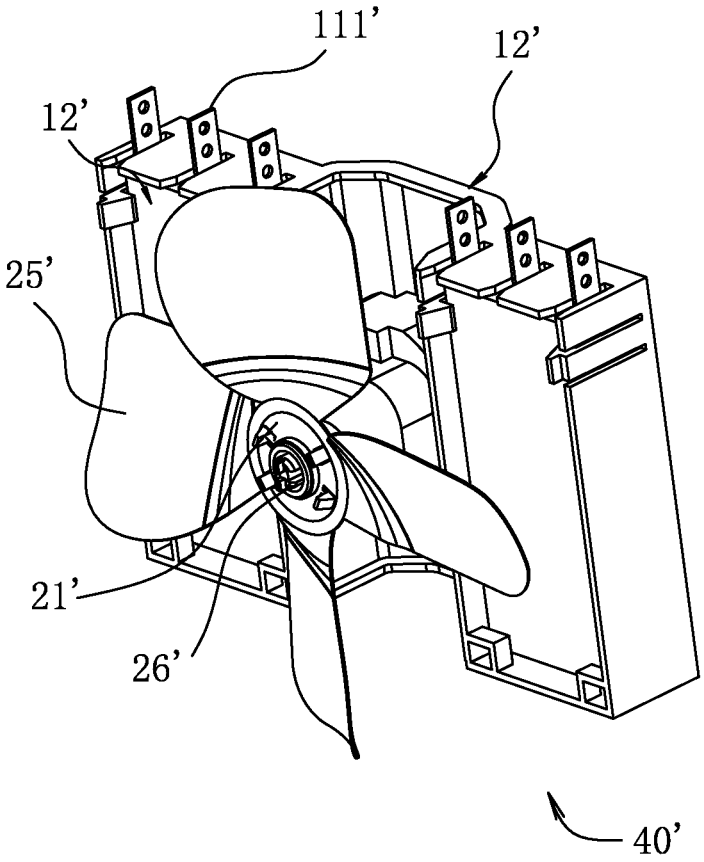
FIG. 11 is another schematic diagram of an integrated air heating and blowing arrangement of the heater according to the second preferred embodiment of the present invention, illustrating that a relative position of two PTC heating assemblies and the fan assembly.
Figure 12:
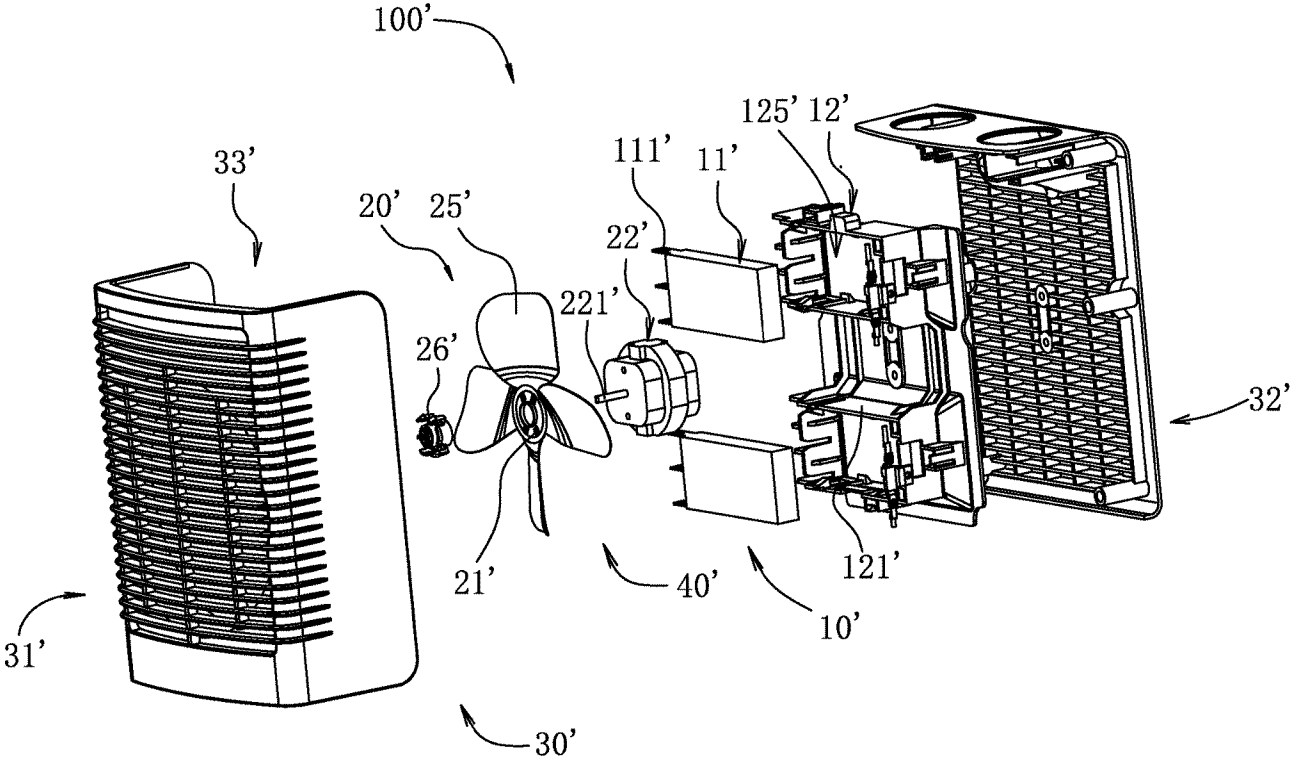
FIG. 12 is an exploded perspective view of the heater according to the second preferred embodiment of the present invention, illustrating that the heater has two PTC heating assemblies and a fan assembly.

Referring to FIG. 7 to FIG. 8 of the drawings, a heater according to a second preferred embodiment of the present invention is illustrated. In this second preferred embodiment, the heater 100' comprises an outer casing 30', and an integrated air heating and blowing arrangement 40'. The integrated air heating and blowing arrangement 40' comprises a fan assembly 20' and a heating apparatus 10'.

The outer casing 30' has at least one air inlet 31', an air outlet 32', and a receiving cavity 33' defined between the air inlet 31' and the air outlet 32'. Both the fan assembly 20' and the heating apparatus 10' are received in the receiving cavity 33' of the outer casing 30'.

According to the second preferred embodiment of the present invention, the outer casing 30' has a cubic structure in which the air inlet 31' is formed on one side of the outer casing 30', while the air outlet 32' is formed in an opposed side of the outer casing 30', so that ambient air drawn by the fan assembly 20' is forced to pass through the receiving cavity 33' along a transverse direction of the outer casing 30'.

The fan assembly 20' comprises a fan rotor 21', a plurality of fan blades 25' extended from the fan rotor 21', a fan motor 22' coupled with the fan rotor' 21 through a connector 26' and a rotating shaft 221' for driving the fan rotor 21' to rotate in a predetermined speed. When the fan rotor 21' is driven to rotate, the fan blades 25' are also driven to rotate in a corresponding direction. In this second preferred embodiment of the present invention, the fan assembly 20' is configured as an axial fan.

The heating apparatus 10 comprises a plurality of Positive Temperature Coefficient (PTC) heating assemblies 11' and a PTC supporting frame 12', wherein each of the PTC heating assemblies 11' is accommodated in the PTC supporting frame 12'. Each of the PTC heating assemblies 11' comprises a PTC heating elements 301' and a plurality of connecting terminals 111' electrically connecting between the PTC heating elements 301' and a power source. In the preferred embodiment, there are four PTC assemblies 11' each of which forms an integral body and is supported in a specific position in the PTC supporting frame 12'.

The PTC supporting frame 12' comprises a frame body 128' having an accommodating cavity 125', a plurality of securing members 121' supported in the accommodating cavity 125' to divide the accommodating cavity 125' into a plurality of accommodating compartments 1251'. As shown in FIG. 7 of the drawings, there are nine accommodating compartments 1251' formed in the frame body 128', in which the fan assembly 20' is supported in one of the accommodating compartments 1251', while the PTC heating assemblies 11' are supported in four other accommodating compartments 1251' respectively. The fan assembly 20' is supported in the middle accommodating compartment 1251' while the four PTC heating assemblies 11' are supported in the accommodating compartments 1251' which are directly adjacent to the middle accommodating compartment 1251'.

As in the first preferred embodiment, the PTC heating assembly 11' may be a charged PTC heating assembly 11' or an insulated PTC heating assembly 11'. The structures of a charged PTC heating assembly and an uncharged PTC heating assembly 11' are identical to that described in the first preferred embodiment.

The present invention, while illustrated and described in terms of a preferred embodiment and several alternatives, is not limited to the particular description contained in this specification. Additional alternatives or equivalent components could also be used to practice the present invention.

What is claimed is:

1. A heater, comprising:

an outer casing having an air inlet, an air outlet, and a receiving cavity defined between said air inlet and said air outlet, wherein said air inlet is formed on one side of said outer casing while said air outlet is formed in an opposed side of said outer casing;

an integrated air heating and blowing arrangement, which comprises:

a fan assembly mounted in said receiving cavity for drawing air from ambient environment to pass through said air inlet and said air outlet, said fan assembly comprising a tubular fan rotor, a plurality of fan blades provided on said tubular fan rotor, a fan motor coupled with said tubular fan rotor for driving said fan rotor to rotate in a predetermined speed, and a fan housing having an incoming air opening positioned corresponding to said air inlet of said outer casing supported in said outer casing, said tubular fan rotor and said fan motor being mounted and received in said fan housing, said fan rotor comprising a rotor frame having a plurality of supporting members, a predetermined number of said fan blades being supported between each two supporting members; and a heating apparatus arranged to heat up said air drawn by said fan assembly, said heating apparatus being coupled with said fan assembly to form an integrated structure mounted in said receiving cavity of said outer casing, said heating apparatus comprising:

a PTC heating assembly comprising a plurality of PTC assembly members, each of said PTC assembly members comprising a PTC heating element and at least one connecting terminal electrically connecting between said PTC assembly member and a power source; and a PTC supporting frame accommodating said PTC heating assembly, said PTC supporting frame comprising a frame body having an accommodating cavity sized and shaped to receive said PTC heating elements, a plurality of securing members for securing said PTC heating assembly in said accommodating cavity, and a coupling member formed at two sides of said PTC supporting frame connecting said fan housing at a position near said incoming air opening, said PTC heating assembly being supported along a longitudinal direction of said fan housing while each of said PTC heating elements being supported along a transverse direction of said fan housing.

2. The heater, as recited in claim 1, wherein each said PTC heating element comprises a heating member and a heat sink element connected to said heating member in such a manner that heat generated by said heating member is arranged to be rapidly transmitted to said heat sink element, said heating member-having a plurality of conducting electrodes provided on two sides of said heating member, and being electrically connected to said heat sink element.

3. An integrated air heating and blowing arrangement for a heater having an outer casing having an air inlet, an air outlet, and a receiving cavity defined between said air inlet and said air outlet, wherein said air inlet is formed on one side of said outer casing while said air outlet is formed in an opposed side of said outer casing, said integrated air heating and blowing arrangement comprising:

a fan assembly mounted in said receiving cavity for drawing air from ambient environment to pass through said air inlet and said air outlet, said fan assembly comprising a tubular fan rotor, a plurality of fan blades provided on said tubular fan rotor, a fan motor coupled with said tubular fan rotor for driving said fan rotor to rotate in a predetermined speed, and a fan housing having an incoming air opening positioned corresponding to said air inlet of said outer casing supported in said outer casing, said tubular fan rotor and said fan motor being mounted and received in said fan housing, said fan rotor comprising a rotor frame having a plurality of supporting members, a predetermined number of said fan blades being supported between each two supporting members; and a heating apparatus arranged to heat up said air drawn by said fan assembly, said heating apparatus being coupled with said fan assembly to form an integrated structure mounted in said receiving cavity of said outer casing, said heating apparatus comprising:

a PTC heating assembly which comprises a plurality of PTC assembly members, each of said PTC assembly members comprising a PTC heating elements and at least one connecting terminal electrically connecting between said PTC assembly member and a power source; and a PTC supporting frame accommodating said PCT heating assembly, said PTC supporting frame comprising a frame body having an accommodating cavity sized and shaped to receive said PTC heating assembly, a plurality of securing members for securing said PTC heating assembly in said accommodating cavity, and a coupling member formed at two sides of said PTC supporting frame connecting said fan housing at a position near said incoming air opening, said PTC heating assembly being supported along a longitudinal direction of said fan housing while each of said PTC heating elements being supported along a transverse direction of said fan housing.

4. The integrated air heating and blowing arrangement, as recited in claim 3, wherein each said PTC heating element comprises a heating member and a heat sink element connected to said heating member in such a manner that heat generated by said heating member is arranged to be rapidly transmitted to said heat sink element, said heating member having a plurality of conducting electrodes provided on two sides of said heating member, and being electrically connected to said heat sink element.

5. The integrated air heating and blowing arrangement, as recited in claim 3, wherein said PTC heating assembly is an insulated PTC heating assembly, each said PTC heating element comprises a heating member electrically connecting to a power source through said connecting terminal, a heat sink member, a thermal conductor conducting heat from said heating member to said heat sink member rapidly, and an electrical insulating member provided between said thermal conductor and said heating member to insulate said thermal conductor from electricity carried by said heating member.

* * * * *